US005163822A

United States Patent [19]

Koelln

[11] Patent Number: 5,163,822

[45] Date of Patent: Nov. 17, 1992

[54] RADIAL PISTON PUMP

[75] Inventor: Harm Koelln, Kiel-Schilksee, Fed. Rep. of Germany

[73] Assignee: Kitronic Gesellschaft fur Mikrotechnik in der Medizin mbH, Kiel, Fed. Rep. of Germany

[21] Appl. No.: 702,811

[22] Filed: May 21, 1991

[30] Foreign Application Priority Data

May 21, 1990 [DE] Fed. Rep. of Germany ..... 4016306

[51] Int. Cl.[5] ..... F04B 7/00

[52] U.S. Cl. ..... 417/515; 417/521; 417/531

[58] Field of Search ..... 417/53, 521, 531, 538, 417/515

[56] References Cited

U.S. PATENT DOCUMENTS

| | | | |
|---|---|---|---|
| 4,173,437 | 11/1979 | Leka et al. | 417/521 |
| 4,176,764 | 12/1979 | Capra et al. | 222/135 |
| 4,359,312 | 11/1982 | Funke et al. | 417/18 |
| 5,066,199 | 11/1991 | Reese et al. | 417/521 |

FOREIGN PATENT DOCUMENTS

| | | |
|---|---|---|
| 380040 | 9/1923 | Fed. Rep. of Germany . |
| 2436627 | 4/1974 | Fed. Rep. of Germany . |
| 3615885 | 11/1987 | Fed. Rep. of Germany . |
| 729061 | 7/1932 | France . |
| 272955 | 6/1928 | United Kingdom . |
| 2126666 | 3/1984 | United Kingdom . |

*Primary Examiner*—Richard A. Bertsch
*Assistant Examiner*—Charles G. Freay
*Attorney, Agent, or Firm*—Nixon & Vanderhye

[57] ABSTRACT

A radial piston pump has a pump body with two pump chambers lying in a straight line. In the pump chambers pistons reciprocate along this same straight line. The pump pistons are coupled to an actuator which is rotatable about an axis which bisects the straight line, and reciprocates the pistons in opposite directions. Each pump chamber is connected to an intake fluid duct and a discharge fluid duct, and the intake ducts are connected to a common main intake duct and the discharge fluid ducts to a common main discharge duct. An actuator controls operating components which co-operate with valve arrangements for the opening and closing of the fluid ducts.

18 Claims, 6 Drawing Sheets

RADIAL PISTON PUMP

BACKGROUND AND SUMMARY OF THE INVENTION

The invention relates to a radial piston pump having a pump body with two pump chambers lying on a straight line. Pump pistons displaceable along the straight line are disposed in the pump chambers, which pump pistons are moved upon a relative rotation of an actuator with respect to the pump body about an axis of rotation which bisects the straight line. At least one fluid duct is connected to each of the pump chambers at its end nearest the axis of rotation, which fluid duct is opened or closed depending on the positions of the actuator and pump body.

In a known radial piston pump of this general type (German Patent Application 36 15 885), which is to be used as a gas compressor, two pairs of pump chambers are present in a cross-shaped pump body, each pair of which lies on a straight line, the two straight lines intersecting each other perpendicularly at the axis of rotation. The rear ends of the pump pistons present in the pump chambers engage a guide which is formed by a housing rotating about the rotation axis, so that, upon rotation of the housing about the pump body, the pump pistons are displaced in the pump chambers along their respective straight lines, the pump pistons of one pair being moved simultaneously outwards or simultaneously inwards [i.e. the pump pistons lying on a common straight line move in the same sense of direction].

In the pump of German 3615885, fluid ducts are connected to the ends of the pump chambers nearest the rotation axis, which fluid ducts extend parallel to the rotation axis to one side of the pump body, while in the housing, on the same radius, openings are formed, which in certain rotation positions are located in alignment with the fluid ducts. These openings serve to allow gas to enter through the fluid ducts into the pump chambers and compressed gas to leave from them, while the compressing process is carried out when the fluid ducts are covered by the housing.

This known radial piston pump is suitable only as a compressor, because only one fluid duct is available for each pump chamber. Furthermore, sealing in the area of the fluid ducts is deficient because it is effected merely by the circular housing wall. Moreover the transition between closed fluid duct and completely open fluid duct takes place by means of a gradual modification of the opening cross-section of the fluid duct, which leads to a very uneven flow and conveyance pattern.

In another known radial piston pump (German Patent No. 24 36 627), several pump chambers are arranged radially in the pump body, and the actuator is mounted eccentrically relative to the center of the pump body, so that upon rotation of the pump body the pistons—coupled with the actuator—are displaced in the pump chambers. A pressure line and a suction line are located in the central region of the pump chambers and upon rotation of the actuator they are alternately connected with the pump chambers [the type of connection is not described in detail]. With this known radial piston pump, a specially designed coupling of the pump pistons with the actuator is necessary, because the pump body and actuator are not housed concentrically. This design is therefore relatively complicated.

Known radial piston pumps, such as described above, are suitable for many applications. If, however, small quantities of liquid (e.g. on the order of microliters) are to be conveyed uniformly and with a high degree of accuracy, not only are very precisely finished individual parts necessary, but control of the piston movement in precise co-ordination with the opening and closing of the fluid ducts of the pump chambers requires a considerable mechanical outlay. For this reason such piston pumps are used as single-part production units in the laboratory sector, but cannot be used in many applications because of high costs.

According to the invention a radial piston pump is designed in such a way that even very small quantities of liquid can be discharged very precisely in a controlled manner, the pump being of very simple design [e.g. so that it is even optionally disposable].

According to the invention, a radial piston pump is provided with pump pistons that are displaced in opposite directions by means of coupling with an actuator. Each pump chamber is connected to an intake fluid duct and to a discharge fluid duct, a valve arrangement being provided in each duct. The valve co-operates with operating means provided on the actuator, and the intake fluid ducts are connected to a common main intake duct and the discharge fluid ducts to a common main discharge duct.

With the radial piston pump according to the invention, the pump pistons lying on a straight line are moved in opposite direction so that fluid is drawn in into one pump chamber via its intake fluid duct, while fluid is discharged out of the other pump chamber via its discharge fluid duct, thus enabling fluid to be continuously conveyed at a pre-set rate. The fluid for both intake fluid ducts is drawn from a common main intake duct, and passed out of the two discharge fluid ducts into a common main discharge duct. The opening and closing of valve means for the intake fluid ducts and the discharge fluid ducts takes place in a precisely controlled way, because the actuator, which causes the forced or positive movement of the pump pistons by rotation about an axis of rotation and is provided with the operating means, moves the valve means for the fluid ducts into opened and closed positions. Thus, the movements of the pump pistons and the control of the valve arrangements for the fluid ducts are carried out synchronously in a precisely pre-set way, so that fluid is completely reproducibly conveyed in a pre-determined manner. This is especially advantageous if the radial piston pump according to the invention is used as an infusion pump in the field of medicine, because it can be used for the simple release of very small quantities of liquid per unit of time over relatively long periods at a constant feed rate, the intake volumes of the pump chambers possibly being of the order of microliters.

In a preferred embodiment of the invention, the actuator has at least one control disc rotatable about its axis of rotation, which control disc has at least one actuator surface for a pump piston and at which is provided an operating means for at least the valve means in the intake fluid duct of one pump chamber and in the discharge fluid duct of the other pump chamber. With this design a single control disc thus serves both to move one pump piston and to operate two valve arrangements, wherein it is also possible to provide the actuator surfaces for both pump pistons at this control disc and optionally to also provide the operating means for all valve means associated with it.

If a control disc with an actuator surface for one pump piston and an operating means for the valve means of an intake fluid duct and of a discharge fluid duct is arranged at one side of the pump body, a corresponding control disc with an actuator surface for the other pump piston and with an operating means for the other valve means can be mounted on the opposite side of the pump body and likewise on the axis of rotation, so that the actuator comprises two control discs, securely connected to each other, lying on both sides of the pump body, which control discs can be simply manufactured and fitted.

The operating means can each have an elastically deformable operating element secured non-rotatably on the pump body, operating projections being provided at the ends of said operating element on the side facing the pump body to act on the associated valve means, while the side of the operating element facing away from the pump body can be brought into engagement with cam faces formed on the control disc.

With such a design, a single operating element, secured non-rotatably on the pump body, serves to activate the valve means, for which cam faces provided on the control disc act on the operating element. In this way the elastic deformation of the operating element and thus the influencing of the valve means is effected by cam faces whose shape is exactly determined and unchangeable, thus achieving great accuracy.

To this end, cam followers can be provided on the side of the operating element facing away from the pump body, and, by engaging with a cam follower, the cam face can effect elastic deformation of an operating element to bring it into engagement with an operating projection.

A circularly arc-shaped extension of the cam face can be a recess for receiving the cam followers, ramps forming transitions to the cam face being provided at the ends of the recess, so that the area of the operating element carrying one cam follower is not deformed if the cam follower is located within the recess. The cam follower can slide over the corresponding ramp for the transfer from recess to cam face and back.

For the movement of the pump pistons by means of one or more control discs, each pump piston can be provided with at least one laterally projecting cam peg, which engages with the associated actuator surface of the control disc. In this way a defined mechanical allocation of control disc position to pump piston position is achieved, without the risk of the pump pistons tilting during displacement movements.

In order to provide a particularly simple design of the radial piston pump according to the invention which is suitable for feeding small quantities of liquid, each fluid duct can have a side opening and be surrounded in this area by a flexible sealing tube. To close the valve means, the operating element can push the part of the sealing tube located in the area of the opening through the side opening into sealing abutment against the wall of the fluid duct facing the opening, in order to close the fluid duct.

The wall facing the opening can be formed by an annular area which surrounds a section of the fluid duct running perpendicular to the central axis of the opening. In this way, the sealing tube can be pressed in a sealing manner against this annular area in order to securely close off the section of the fluid duct running perpendicular to the central axis of the opening.

The structure can be further simplified in that the openings of the two intake fluid ducts, and the openings of the two discharge fluid ducts, lie coaxially relative to each other. Sections running perpendicular to the central axis of the opening are joined to each other, the associated main duct being connected to these joints.

In this way the openings of both intake fluid ducts can be covered with a single sealing tube or sealing tube section and the openings of both discharge fluid ducts can be covered with another sealing tube or sealing tube section. By means of the associated operating elements one intake fluid duct and one discharge fluid duct can, for example, be alternately sealed off, while the other two fluid ducts are kept open, so that liquid is sucked in through the opened intake fluid duct from the main intake duct into an associated pump chamber, while liquid is forced out of the other pump chamber through the opened discharge fluid duct to the main discharge duct.

DETAILED DESCRIPTION OF THE DRAWINGS

Figure 1:
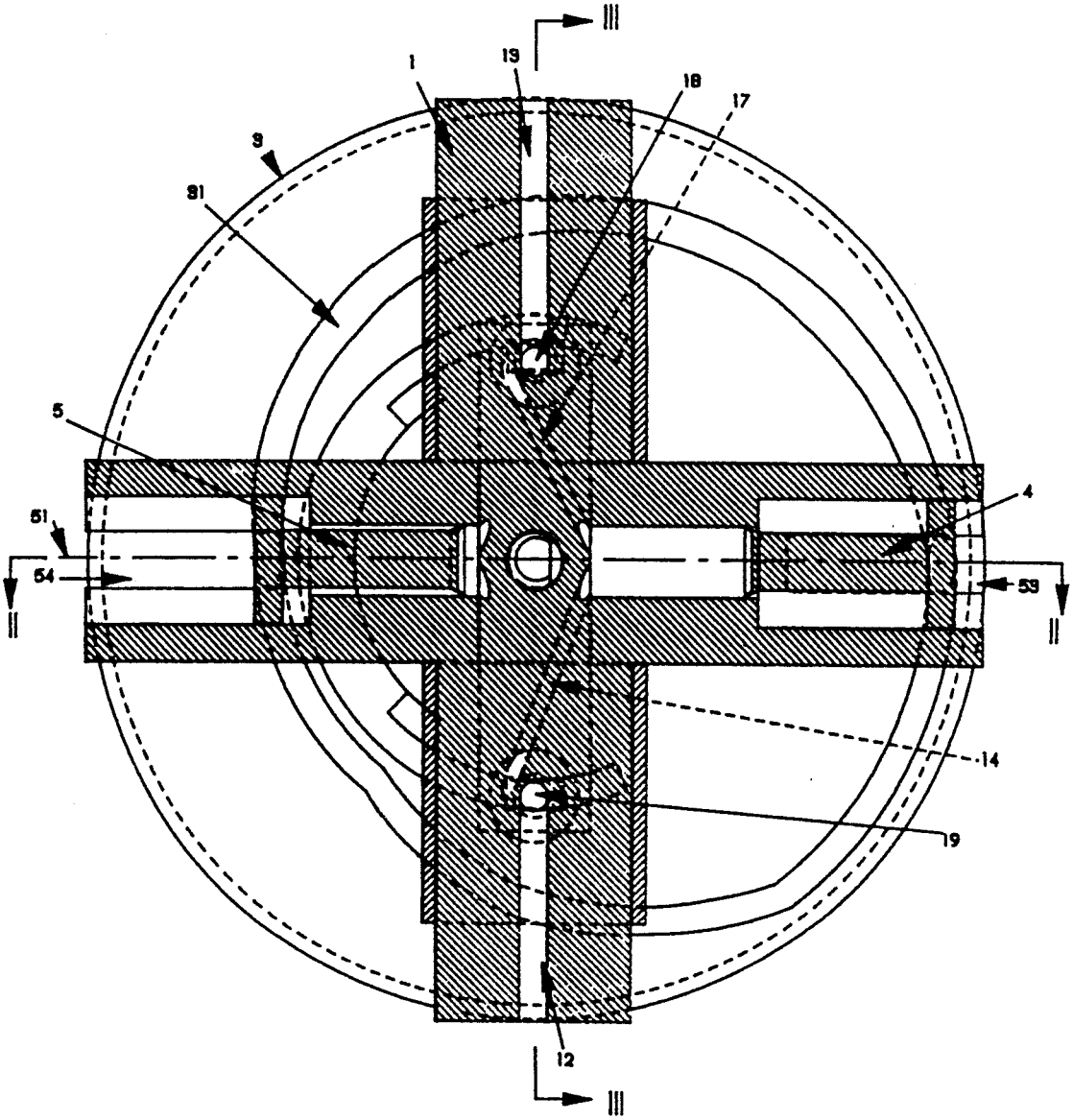
FIG. 1 is a simplified, diagrammatic sectional view along the line I—I of FIG. 3 of an exemplary radial piston pump according to the invention.

The radial piston pump represented in FIGS. 1 to 4 has a cross-shaped pump body 1 with a central opening 48 (FIG. 4), the central axis of which coincides with an axis of rotation 50 (hereafter described). In opposing sections of the pump body 1, on a straight line 51 running perpendicular to and bisecting the axis 50, pump chambers 10, 11 are provided which lie on opposite sides of the axis 50 of the central opening 48 and equidistant from the latter. Pump pistons 4, 5 are provided in the pump chambers 10, 11, having conventional sealing lips (not shown) at their front ends. The pistons 4, 5 are also in-line with each other. Molded to the rear ends of the pump pistons 4, 5, are cam pegs 6, 7 and 8, 9 projecting radially outwards, which extend into guide slots (recesses) 53, 54 in the pump body 1, which are open at their ends lying radially outwards, the cam pegs 6, 7 and 8, 9 projecting in their longitudinal direction over the pump body 1 (see FIG. 2).

In the one section offset by 90° relative to the pump chambers 10, 11 of the cross-shaped pump body 1 there is a main intake duct 13, and in the other section offset by 90° there is a main discharge duct 12. These sections of the pump body 1 can be connected to a conventional liquid reservoir by hoses or tubular connections, or can be connected to a liquid receiver. These sections also can serve to secure the pump body 11, by means of a frame (not shown), on a support plate (not shown).

From the bases of the pump chambers 10, 11 near to the central opening 48, fluid ducts extend to the main ducts 12 and 13, i.e. from the pump chamber 10 extends an intake fluid duct 17 to the main intake duct 13 and a discharge fluid duct 14 to the main discharge duct 12 and, from the base of the pump chamber 11, an intake fluid duct 15 to the main intake duct 13, and a discharge fluid duct 16 to the main discharge duct 12. At the inner ends of main intake duct 13 and main discharge duct 12, continuous, laterally extending sections 19 and 18 are present, at the ends of which are provided annular ducts 21 and 23 or 20 and 22 encircling the openings formed by sections 19 and 18, each annular duct being connected to a fluid duct 17, 15, 14, 16. Thus, the inner wall of each of these annular ducts forms an annular bead, so that annular bead 29 and annular bead 27 encircle the openings at the ends of section 19 and annular bead 26 and annular bead 28 the openings at the ends of section 18.

The cross-shaped pump body 1 can be manufactured very simply from plastic material by the injection-molding process, and can thus be produced in large quantity.

In the fitted state, the pump body 1 is located between two control discs 2, 3, which are securely connected to each other by means of a shaft 49 arranged coaxially to the axis of rotation 50, the shaft 49 being rotatably accommodated by the central opening 48 of the pump body 1. The shaft 49 can be secured rotatably in a frame (not shown) with the aid of which it is kept in a predetermined axial position relative to the pump body 1. By means of a conventional power device 60, which for example acts on shaft 49 or via a toothed wheel engaging a correspondingly toothed periphery (not shown) of control discs 2 and 3, the unit comprising control discs 2, 3 and shaft 49 can be rotated about the axis of rotation 50.

On the face of control disc 3 facing the pump body 1, a closed actuator surface 31 is present, which receives the cam pegs 7 and 9 of pistons 4 and 5. An identically shaped and identically arranged actuator surface 30 (FIG. 3) is located in control disc 2, receiving cam pegs 6 and 8 of pump pistons 4 and 5. Upon rotation of control discs 2, 3 about rotation axis 50, pump pistons 4 and 5 are thus reciprocated opposite each other according to the shape of actuator surfaces 30 and 31, as will be described in detail in connection with FIG. 6. The control discs 2, 3 are of basically identical design, so that hereinafter only the design of control disc 3, which is seen in FIG. 4, will be described in detail.

Figure 4:
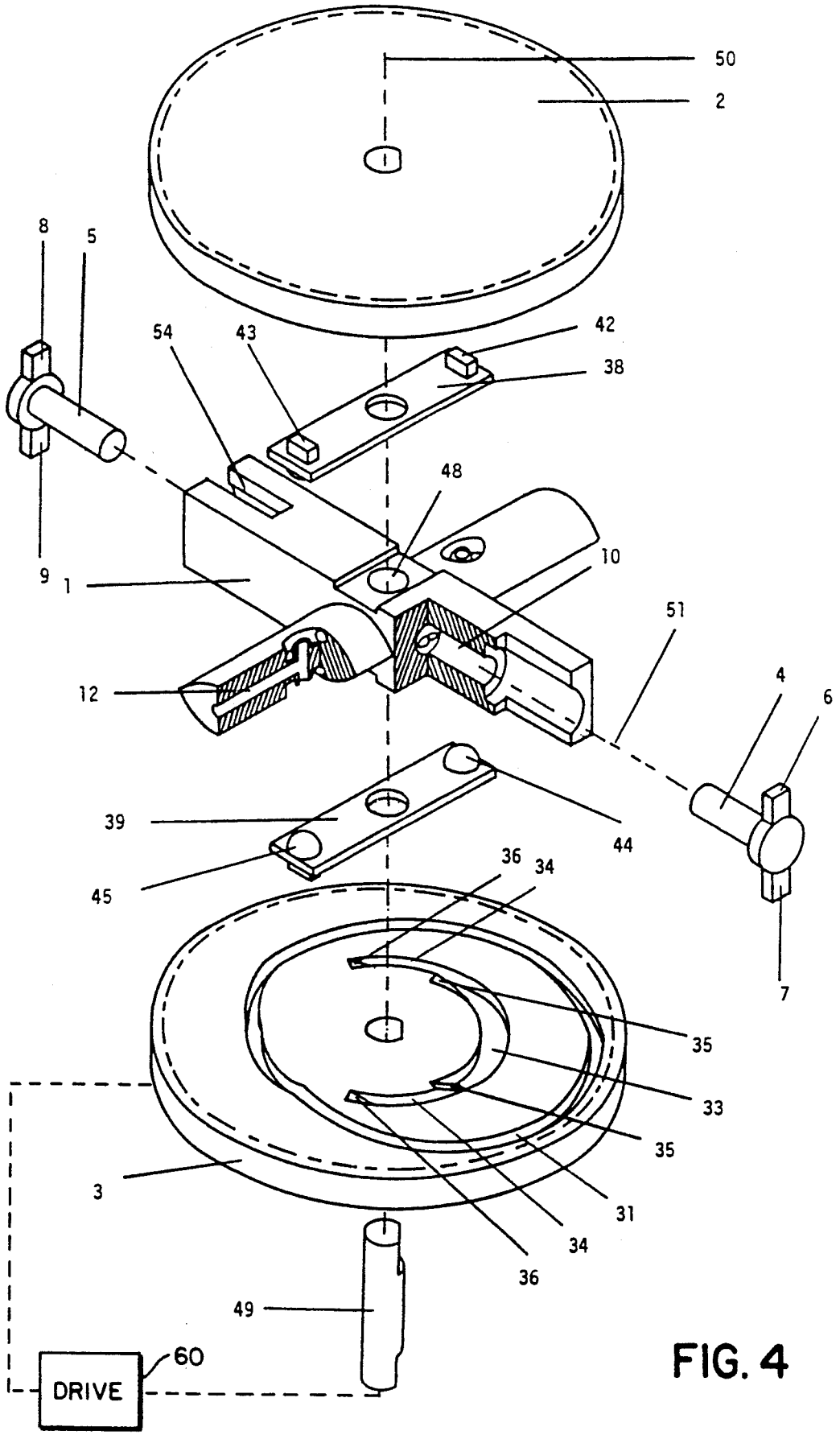
FIG. 4 shows, in an exploded representation and partly broken away, the pump body, the control discs and further illustrates parts of the radial piston pump from FIGS. 1 to 3.
Figure 5:
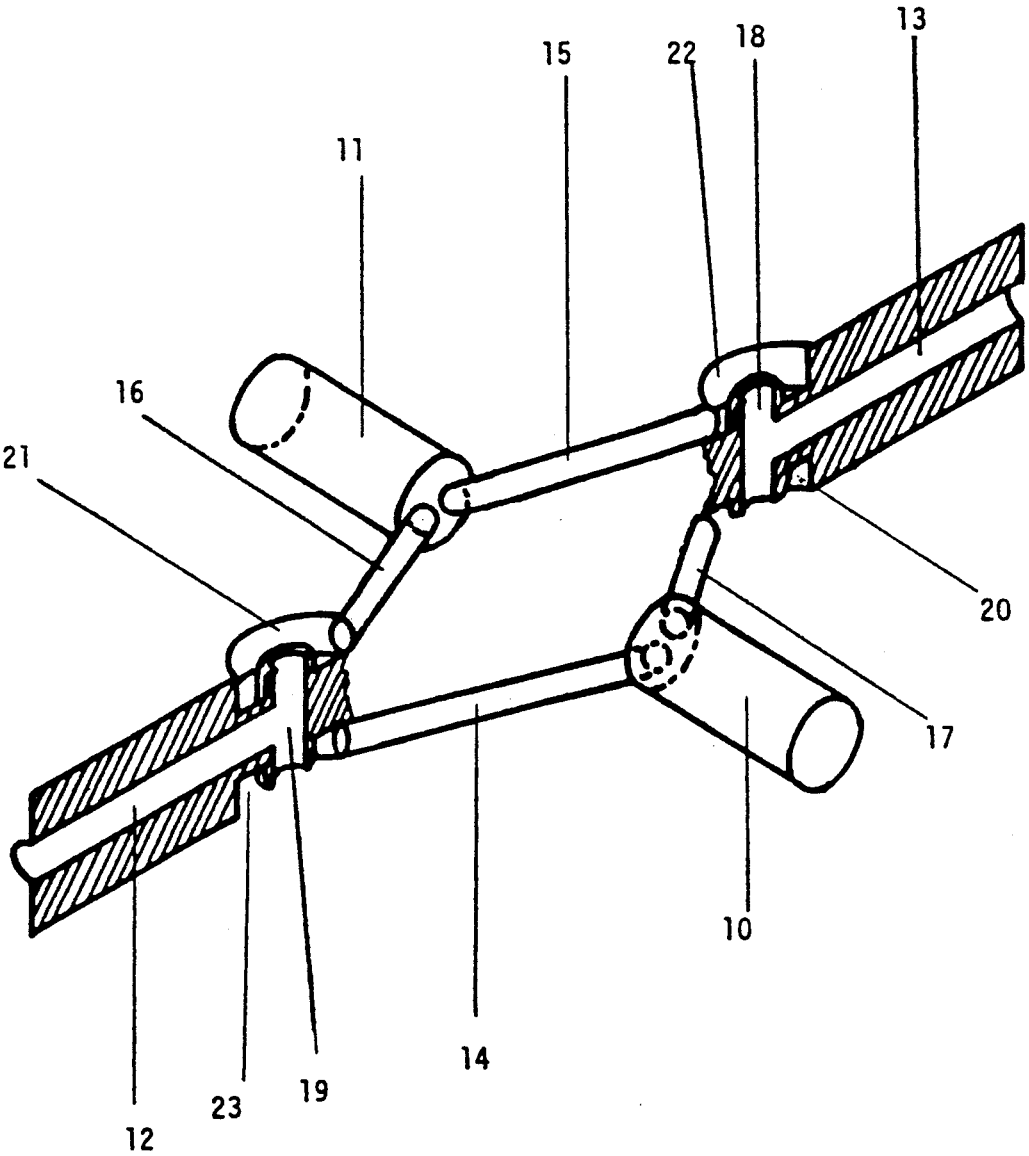
FIG. 5 is a digrammatic representation of the arrangement of the fluid ducts between the pump chambers and the main ducts.

Also located in control discs 2 and 3 are arc-shaped recesses running coaxially to axis of rotation 50, it being seen from FIG. 4 that the arc-shaped recess in control disc 3 comprises several sections, i.e. a central section 33 which is wider than the outer sections 34 adjoining it. At the radially inward lying edge of the wall laterally adjacent section 33, ramps 35 are provided, rising at the ends, which terminate at the essentially continuous upper face of control disc 3. Sections 34, forming continuations of sections 33, lie with their radially inner wall somewhat further remote from axis 50 and sections 34 end at ramps 36, which lead to the essentially continuous, level face of control disc 3.

Figure 6:
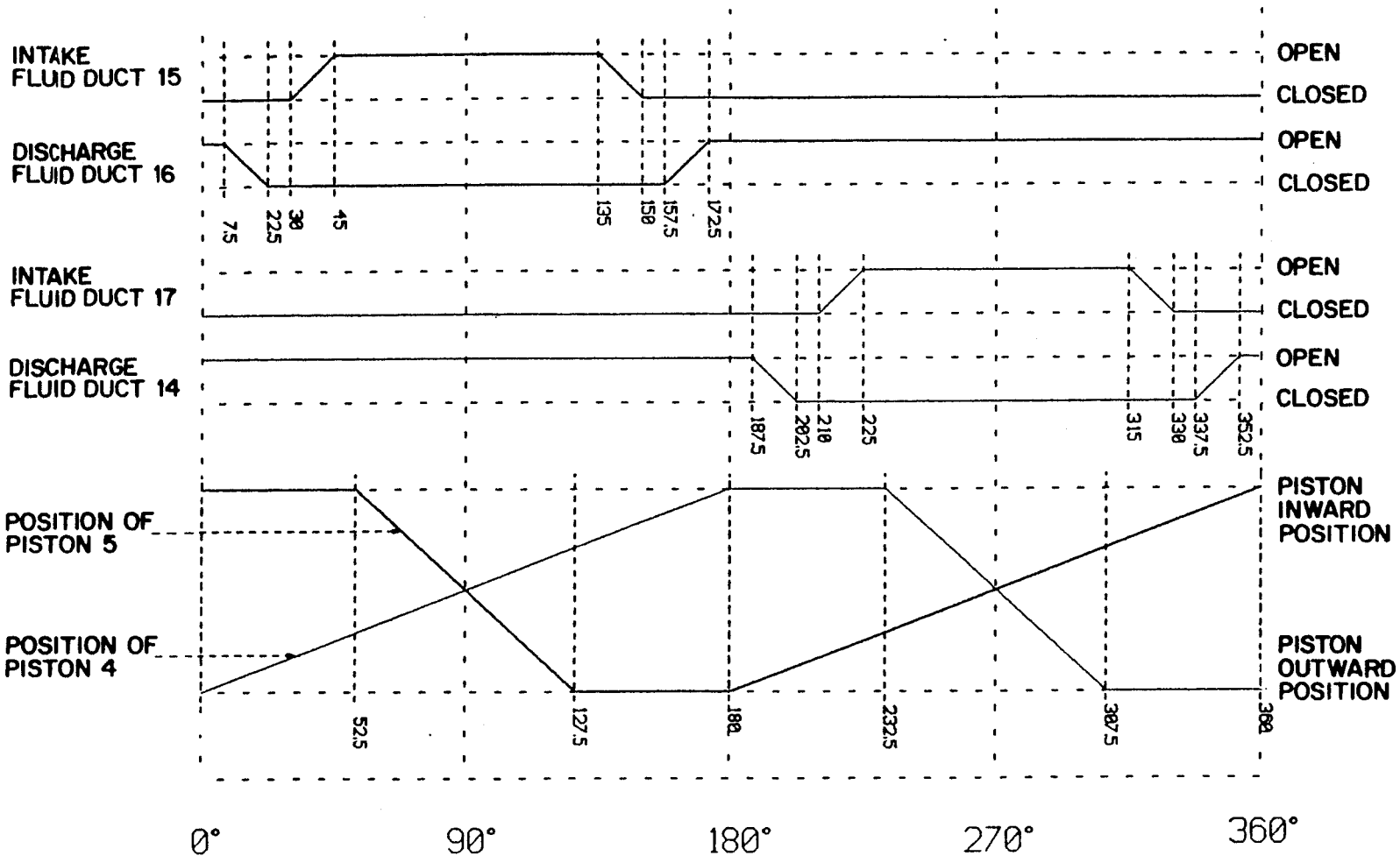
FIG. 6 is a shows in a diagram that various operating positions and states of parts of the radial piston pump as per FIGS. 1 to 5.

A correspondingly shaped recess 37 is provided on the face of control disc 2 facing the pump body 1 (FIG. 3), but this recess is offset in the peripheral direction relative to the recess formed by sections 33 and 34, as illustrated in FIG. 6. Circularly arc-shaped planar areas adjoining ramps 35 and 36 and lying concentrically to axis of rotation 50 on the non-recessed surface of control disc 3 form cam faces (not shown).

On both sides of the pump body 1, rectangular plate elements 38, 39, serving as operating means for the valve arrangements, are non-rotatably mounted. Plate element 38 is disposed between pump body 1 and the face of control disc 2 facing it, and plate element 39 is between pump body 1 and the face of control disc 3 facing it. Both plate elements 38, 39 lie—in their longitudinal direction—parallel to the central axis of main ducts 12, 13, lying on a common straight line. The two plate elements 38 and 39 are identically constructed and probably consist of elastically deformable material, for example plastic material or metal.

At the face facing the adjacent control disc, 2, 3, each plate element 38, 39 has cam followers 42, 43 and 40, 41 (FIGS. 3 and 4), respectively. The cam followers 43 and 41 are at such a distance from axis rotation 50 that upon rotation of control discs 2, 3, they can traverse the two sections of the recesses in the control discs, i.e. cam follower 41 can traverse sections 33 and 34 of the recess in control disc 3, and can exit at one end ramp 36 (FIG. 4) and enter it at the other end ramp 36. In comparison, cam followers 42 and 40 of plate elements 38 and 39 are at a slightly lesser distance from rotation axis 50, so that they can only enter the central section of the recess, i.e. in control disc 3 control cam 40 traverses only section 33 and exits at one of ramps 35 and enters section 33 of the recess at the other ramp 35 (FIG. 4).

Figure 3:
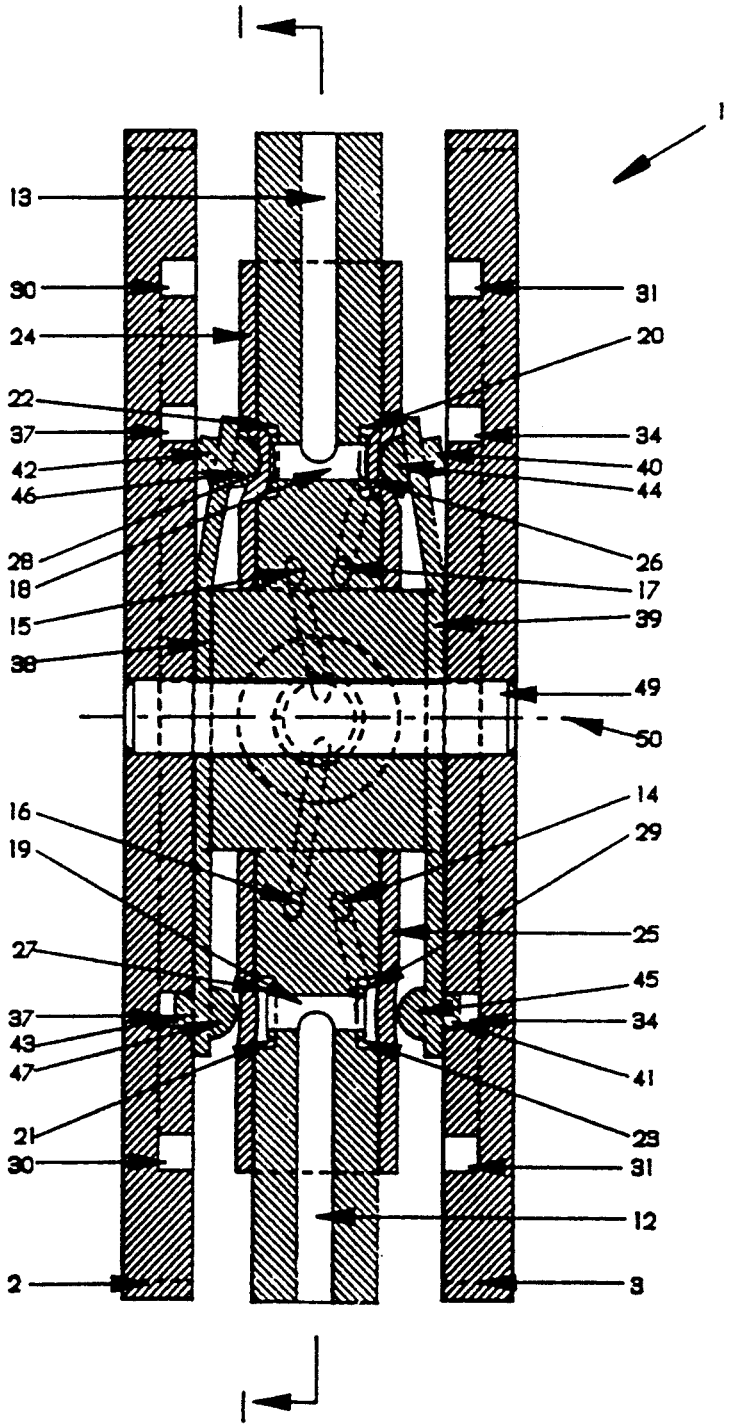
FIG. 3 is a simplified, diagrammatic sectional view along the line III—III of FIG. 1.

When one of cams 42, 43 or 40, 41 of plate elements 38, 39 is located in an associated recess in control disc 2 or 3, the end of the associated plate element 38, 39 is not deformed, as is shown in FIG. 3 for the end of plate element 38 carrying cam follower 43 and the end of plate element 39 carrying cam follower 41. However, if the associated control disc 2, 3 is so rotated such that a cam follower is located outside the recess 33 and/or 34, an end of associated the plate element 38, 39 is elastically deformed in the direction of pump body 1 by the area of control disc 2, 3 forming one cam face. This deformed position is represented in FIG. 3 for the end of plate element 38 carrying cam follower 42 and the end of plate element 39 carrying cam follower 40.

At the sides of plate elements 38 and 39 opposite cam followers 42, 43 and 40, 41, essentially semi-spherical operating projections 46, 47 and 44, 45 are provided, their distance from rotation axis 50 being chosen such that they lie exactly in the center of the transversely running sections 18 or 19 of main ducts 12, 13. Thus, operating projection 44 is arranged centrally to annular bead 26, operating projection 45 centrally to annular bead 29, operating projection 46 centrally to annular bead 28, and operating projection 47 centrally to annular bead 27 (FIG. 3).

As is seen particularly in FIG. 3, located on the sections of cross-shaped pump body 1 forming main ducts 12, 13, are sealing tubes 24 and 25. Tubes 24, 25 are preferably made of silicone rubber, and sit firmly on these sections, and effect sealing by covering the areas of fluid ducts 14, 16 and 15, 17 forming the lateral openings.

Sealing tubes 24 and 25, which consist of readily elastically deformable material, are, as FIG. 3 shows in particular, elastically deformed by the elastic deformation of the ends of plate elements 38 and 39 as a result of engagement with the operating projections 46, 47 and 44, 45 sitting at these ends, in such a way that they abut in a sealing manner against the adjacent annular bead and thus seal off the associated fluid duct vis-à-vis the main duct. Thus, in FIG. 3, as a result of elastic deformation of the end of plate element 38 carrying operating projection 46, the adjacent area of sealing tube 24 is pressed against annular bead 28, so that the annular duct 22 encircling annular bead 28, including the intake fluid duct 15 connected to this annular duct, is sealed off vis-à-vis section 18, which runs transversely, and thus vis-à-vis main intake duct 13 (i.e. the intake connection for pump chamber 11 is closed, while the chamber 11 discharge connection is opened via unsealed discharge fluid duct 16). Accordingly, the adjacent area of sealing tube 24 is pressed by cam follower 44 against annular bead 26 and thus annular duct 20 and intake fluid duct 17 are sealed off vis-à-vis main intake duct 13 (i.e. the intake connection for pump chamber 10 is likewise closed, while the discharge connection is opened via discharge fluid duct 14).

As already mentioned above, during operation of the radial piston pump control discs 2, 3 are rotated about axis 50 so that actuator surfaces 30 and 31 and the cam faces of control discs 2 and 3 (limited by recess sections 37, 33 and 34) act on cam pegs 6, 7 and 8, 9 of pump pistons 4 and 5 and also on cam followers 42, 43 and 40, 41 according to the shape of the surfaces, in order to displace pump pistons 4, 5 in a controlled manner for the intake and discharge of fluid, and also to open and close the intake fluid ducts and the discharge fluid ducts in a controlled manner.

A typical and preferred sequence of these operations is shown in the diagram of FIG. 6. The intake movement of the pistons is quicker than the discharge movement and the opening and closing movements of the various fluid ducts take place in the rest positions of the associated pump pistons, so that exactly defined amounts of liquid are inducted into the corresponding pump chamber 10, 11 and discharged from it. During this process, pump pistons 4, 5 move in such a way that the discharge of liquid by a pump piston begins when the discharge of liquid by the other pump piston ends, so that liquid is conveyed continuously, and also—due to the constant rate of displacement of the pump pistons when discharging—at a constant conveyance rate.

The diagram of FIG. 6 illustrates the various movement sequences during a complete revolution of control discs 2, 3.

Figure 2:
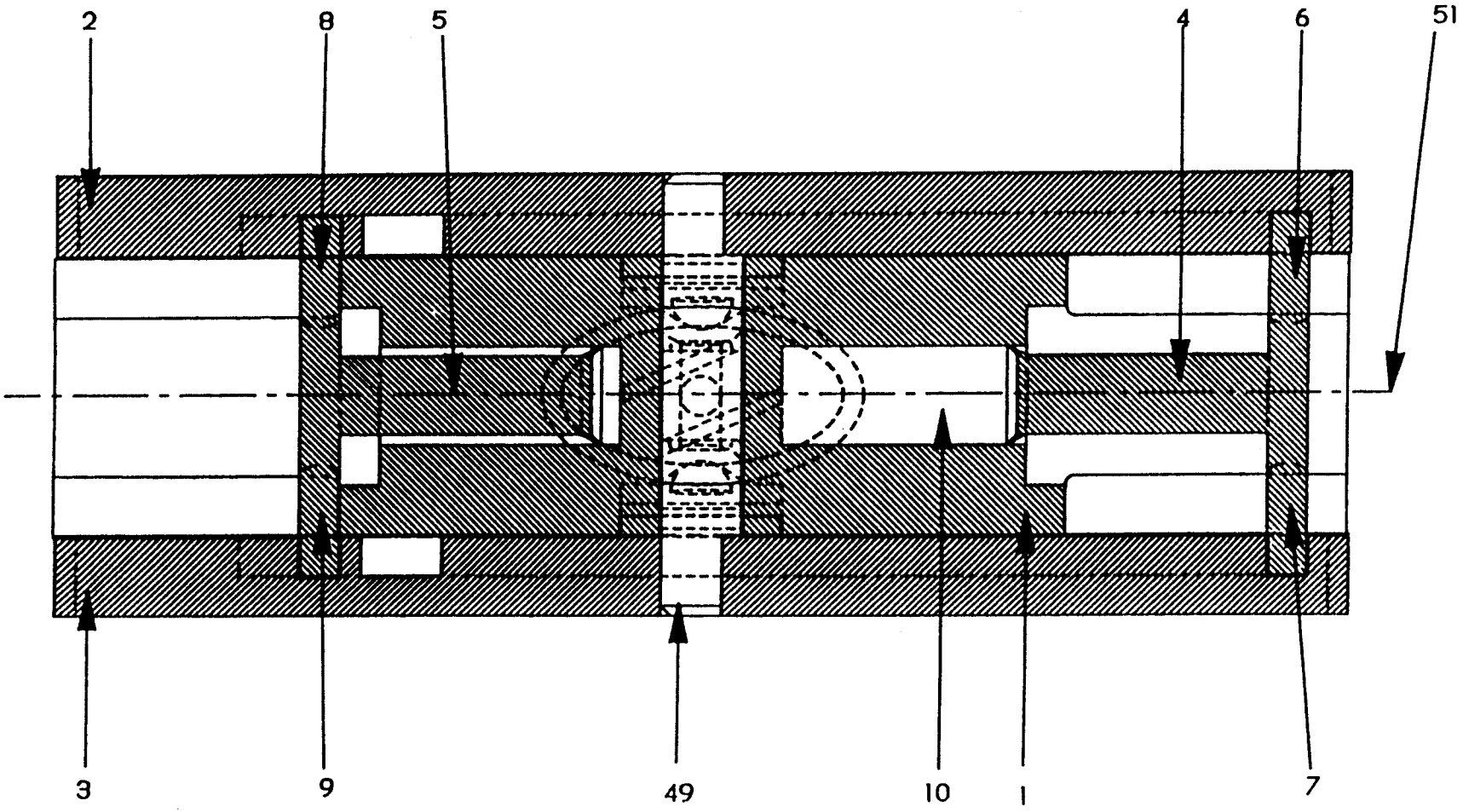
FIG. 2 is a simplified, diagrammatic sectional view along the line II—II of FIG. 1.

It is assumed that, in the position identified as 0°, pump piston 5 has completely entered pump chamber 11, while pump piston 4 is just beginning the movement into pump chamber 10, i.e. is discharging liquid, as shown in FIGS. 1, 2 and 3. In this position intake fluid duct 17, which is connected to pump chamber 10 (accommodating pump piston 4), is closed, because cam follower 40 of plate element 39 engages the cam face of control disc 3 and thus there is an elastic deformation of plate 39 which displaces operating projection 44. In contrast, discharge fluid duct 14 is open, so that liquid can be forced out of the pump chamber 10 through discharge fluid duct 14 into main discharge duct 12. Because of the just-ended discharge movement of pump piston 5, discharge fluid duct 16, which is connected to pump chamber 11, is still open (upper part of diagram of FIG. 6), but is closed shortly afterwards. Accordingly, intake fluid duct 15 is still closed because pump piston 5 is within chamber 11 and an intake process is not to take place.

Upon further rotation of the control discs 2, 3 from position 0°, with a constant rate of entry of pump piston 4, which is determined by the shape of the corresponding section of actuator surfaces 30 and 31 in the control discs 2 and 3, liquid is forced out of pump chamber 10. After a relatively short arc of rotation (approximately 7.5°), discharge fluid duct 16 of pump chamber 11 begins to close, this closing process ending after approximately 22.5°, whereupon the opening of intake fluid duct 15 of pump chamber 11 starts at approximately 30°, and ends at approximately 45°. During this change-over of the fluid ducts of pump chamber 11, pump piston 5 has not moved out of its entered position. Only at approximately 52.5° is pump piston 5 moved radially outwards relative to rotation axis 50 at relatively high speed corresponding to the shape of actuator surfaces 30 and 31, inducting liquid through intake fluid duct 15. This intake process is ended at approximately 127.5°, and at approximately 135° intake fluid duct 15 begins to close, so that it is completely closed at approximately 150°. During this whole time pump piston 4 conveys liquid through discharge fluid duct 14.

At approximately the 157.5° position, discharge duct 16 of pump chamber 11 begins to open, without a displacement movement of pump piston 5, which has moved completely radially outwards. This opening process ends at approximately the 172.5° position.

At the 180° position, pump piston 4 has ended its discharge movement and pump piston 5 begins its discharge movement, operating at the same speed as did pump piston 4 previously. Shortly afterwards, at approximately 187.5°, discharge fluid duct 14 of pump chamber 10 begins to close and this fluid duct is closed at approximately 202.5°. Subsequently, at approximately 210°, intake fluid duct 17 of pump chamber 10 begins to open. This opening movement is ended at approximately 225°. The return movement of pump piston 4 begins only at approximately 232.5°, and thus the intake of liquid through the open intake fluid duct 17. Pump piston 4 and the associated fluid ducts now work in the same way as did pump piston 5 previously after commencing its intake movement at approximately 52.5°, so that at 360° pump piston 4 is once more in the 0° position, and pump piston 5 at the 360° position. The same applies to the various fluid ducts.

Actuator surfaces 30 and 31 and the cam faces of control discs 2 and 3, limited by recess sections 33, 34 and 37, thus serve to control these movement sequences. It is clear that by changing the shapes of these actuator surfaces 30, 31, and cam faces, the sequence of the pump piston movements and of the opening and closing of the fluid ducts can be changed.

According to the present invention there also is provided a method of pumping small quantities of liquid in a precise and continuous manner over a long period of time. The method comprises the steps of: (a) Reciprocating the pistons in the chambers so that they move in directions opposite to each other. And, (b) during the practice of step (a) connecting the inlet ducts of the first piston to the main inlet duct during the majority of the time the outlet duct of the second piston is connected to the main outlet duct, and vice versa.

As the previously described embodiment shows, the represented radial piston pump is extremely simple in construction, because it essentially consists of only six parts, that is the pump cross or body 1, a component comprising control discs 2 and 3 securely connected by the shaft 49, two pump pistons 4, 5 and two plate elements 38 and 39. As can be easily seen, these parts can be simply manufactured as mass-produced articles, such as from plastics material, and yet, with the aid of the pump, a very precisely controlled, continuous conveyance of small amounts of liquid at an essentially constant conveyance rate is possible.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A radial piston pump comprising:

a pump body defining first and second pump chambers, said chambers lying on a common straight line;

first and second pistons disposed in said first and second chambers for reciprocation in line with each other along said common straight line;

an actuator rotatable about an axis of rotation, said axis bisecting said common straight line;

each chamber having an inlet fluid duct and an outlet fluid duct adjacent the ends thereof closest to said axis;

said inlet fluid ducts connected to a main inlet fluid duct, and said outlet fluid ducts connected to a main outlet fluid duct;

valve means for controlling fluid communication between said inlet ducts and main inlet duct, and outlet ducts and main outlet duct; and means for connecting said actuator to said pistons and valve means so that upon rotation of said actuator about said axis of rotation said pistons are moved in opposite directions, and said valve means are operated so that only one inlet duct at a time is connected to said main inlet duct, and only one outlet duct at a time to said main outlet duct.

2. A pump as recited in claim 1 wherein said actuator comprises at least one control disc, said control disc having an actuator surface in operative association with a pump piston, and having an operating means for said valve means for controlling at least the in-take fluid duct of one pump chamber and the discharge fluid duct of the other pump chamber.

3. A pump as recited in claim 2 wherein said actuator comprises first and second coaxially arranged control discs lying on opposite sides of said pump body, said control discs having essentially identical actuator surfaces and essentially identical operating means.

4. A pump as recited in claim 2 wherein said operating means comprises an elastically deformable operating element which is non-rotatably mounted on the pump body, and said elastically deformable operating element cooperates with movable operating projections which are operatively associated with said control disc.

5. A piston as recited in claim 4 wherein said means for operatively connecting a piston to a control disc comprises means defining cam recesses in said control disc face, and a cam projection extending radially outwardly from said piston and for engagement with a said cam recess.

6. A pump as recited in claim 4 wherein said operating projections are moved toward and away from a position elastically deforming an operating element by cam followers attached to said operating elements, and cam recesses formed in said control disc.

7. A pump as recited in claim 6 wherein each of said cam recesses comprises an arc-shaped recess having ramps at the ends thereof for providing transition between the cam face and the recess.

8. A piston as recited in claim 2 wherein said means for operatively connecting a piston to a control disc comprises means defining cam recesses in said control disc face, and a cam projection extending radially outwardly from said piston and for engagement with said cam recess.

9. A pump as recited in claim 1 wherein each of said inlet and outlet fluid ducts has a side opening which is surrounded by a flexible sealing tube, said tube being deformable by an operating element to access its side opening to seal said sealing tube against the wall of each of said fluid ducts.

10. A pump as recited in claim 1 wherein said connecting means comprise means for opening and closing valve means associated with each pump chamber when the piston in the chamber is at a standstill.

11. A pump as recited in claim 1 wherein said connecting means comprise means for effecting the in-take movement of each of said pump pistons more quickly than the discharge movement thereof, and for holding one pump piston at a standstill upon commencement of the discharge movement of the other pump piston.

12. A pump as recited in claim 1 wherein each of said intake ducts and discharge ducts has an opening to said chamber, and wherein said discharge openings of said chambers are coaxial with each other, and the intake openings in said chambers are coaxial.

13. A method of controlling a pump to pump small amounts of liquid in a precisely controlled manner, using a pump body having first and second in line pump chambers, and first and second in line pistons reciprocal in the chambers, a main inlet duct, a main outlet duct, and an inlet and outlet duct connected from each chamber to the main inlet and outlet ducts, said method comprising the steps of:

(a) reciprocating the pistons in the chambers so that as one is being withdrawn from a chamber the other is being inserted into the chamber; and (b) during the practice of step (a) connecting the inlet ducts of the first piston to the main inlet duct during the majority of the time the outlet duct of the second piston is connected to the main outlet duct, and vice versa, by connecting a pump chamber to a main intake duct or main discharge duct only when the piston in that chamber is at a standstill.

14. A method as recited in claim 13 wherein step (a) is practiced by moving the pistons more quickly during an intake stroke thereof than during the discharge stroke thereof, and wherein each piston is at a standstill upon commencement of the discharge movement of the other piston.

15. A radial piston pump comprising:

a pump body defining first and second pump chambers, said chambers aligned on a common straight line;

first and second pistons disposed on said first and second chambers for reciprocation in line with each other along said common straight line;

an actuator rotatable about an axis of rotation, said axis bisecting said common straight line, said actuator comprising first and second control discs mounted on opposite sides of said body, each control disc concentric with said axis of rotation;

each chamber having an inlet fluid duct and an outlet fluid duct;

valve means for controlling fluid communication between said inlet and outlet ducts; and means for connecting said control discs to said pistons and valve means so that upon rotation of said actuator about said axis of rotation said pistons are moved in opposite directions, and said valve means are operated so that fluid is being supplied to one inlet duct during the majority of the time that fluid is being exhausted from the opposite outlet duct, and vice versa.

16. A pump as recited in claim 15 wherein each control disc has a cam face having a pair of arcuate recesses therein, and wherein said connecting means comprise cam follower elements for said pistons in one cam recess, and cam follower elements for said valve means in the other cam recess.

17. A pump as recited in claim 16 wherein said connecting means further comprise elastically deformable operating elements non-rotatably mounted on said pump body and including the cam followers for communication with one of said arcuate recesses.

18. A pump as recited in claim 15 wherein said valve means comprises a flexible sealing tube surrounding a fluid duct.

* * * * *